US008811884B2

(12) United States Patent
Suzuki

(10) Patent No.: US 8,811,884 B2
(45) Date of Patent: Aug. 19, 2014

(54) IMAGE-FORMING APPARATUS AND MULTIPLE SHEET CURL CORRECTING SHEET-RECEIVING UNITS

(75) Inventor: Shiroh Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 240 days.

(21) Appl. No.: 12/722,834

(22) Filed: Mar. 12, 2010

(65) Prior Publication Data

US 2010/0166474 A1 Jul. 1, 2010

Related U.S. Application Data

(62) Division of application No. 11/078,329, filed on Mar. 14, 2005, now Pat. No. 7,711,310.

(30) Foreign Application Priority Data

Mar. 15, 2004 (JP) ..... 2004-073535

(51) Int. Cl.
*G03G 15/00* (2006.01)

(52) U.S. Cl.
USPC ..... 399/405; 399/111; 399/397; 271/279

(58) Field of Classification Search
USPC ..... 399/405, 110, 113, 112, 125, 116, 162; 271/213, 279; 400/691; 347/170, 152
See application file for complete search history.

(56) References Cited

U.S. PATENT DOCUMENTS

| | | | | |
|---|---|---|---|---|
| 4,185,908 | A * | 1/1980 | Taylor et al. | 399/367 |
| 4,353,542 | A | 10/1982 | Knight et al. | 271/294 |
| 5,046,717 | A | 9/1991 | Ettischer et al. | 271/219 |
| 5,154,411 | A | 10/1992 | Saito et al. | 271/289 |
| 5,963,754 | A | 10/1999 | Itoh et al. | 399/21 |
| 5,984,299 | A * | 11/1999 | Hirota et al. | 271/161 |
| 5,987,299 | A | 11/1999 | Kopp et al. | 399/384 |
| 6,070,031 | A * | 5/2000 | Haneda et al. | 399/112 |
| 6,212,344 | B1 * | 4/2001 | Takagi et al. | 399/112 |
| 6,385,433 | B1 * | 5/2002 | Sawada | 399/405 |
| 6,408,147 | B1 * | 6/2002 | Oshida | 399/82 |
| 6,685,180 | B2 * | 2/2004 | Saegusa et al. | 270/58.08 |

FOREIGN PATENT DOCUMENTS

| | | | |
|---|---|---|---|
| JP | 63-200562 | | 12/1988 |
| JP | 04-085260 | | 3/1992 |
| JP | 04085260 | A * | 3/1992 |
| JP | 10-291711 | | 11/1998 |
| JP | 11-35226 | | 2/1999 |
| JP | 2001-63898 | A | 3/2001 |
| JP | 2001-109211 | A | 4/2001 |
| JP | 2002-308511 | A | 10/2002 |

* cited by examiner

*Primary Examiner* — Matthew G Marini
(74) *Attorney, Agent, or Firm* — Sughrue Mion, PLLC

(57) ABSTRACT

A sheet discharge tray that forms a sheet-receiving unit in an image-forming apparatus includes a climbing slope from a sheet discharge direction start point to a sheet discharge direction end point. The sheet discharge direction end point is formed by a variable tray having a supporting portion provided on a side of the sheet discharge direction start point.

19 Claims, 12 Drawing Sheets

IMAGE-FORMING APPARATUS AND MULTIPLE SHEET CURL CORRECTING SHEET-RECEIVING UNITS

This application is a Divisional of Copending U.S. patent application Ser. No. 11/078,329 filed Mar. 14, 2005 as U.S. Pat. No. 7,711,310 and claims the benefit of the Japanese Patent Application No. 2004-073535 filed on Mar. 15, 2004, both of which are hereby incorporated by reference in their entirety.

BACKGROUND OF THE INVENTION

1. Field of the Invention

This invention relates to image-forming apparatuses, in particular, to a sheet discharge unit or a sheet discharge tray provided for loading a printed sheet of paper.

2. Description of the Related Art

Conventionally, an image-reading unit (scanner) and an image-forming unit are separately arranged above and below. The image-reading unit (scanner) is arranged above the image-forming unit having an image-fixing unit and the like. The image-reading unit (scanner) and an image-forming unit are separately arranged so that the sheet discharge tray may not protrude from side faces of the image-forming unit. The sheet discharge tray is used for loading printed sheets of paper. Thus arranged image-reading unit and the image-forming unit forms a space for providing the sheet discharge unit.

Recently, with the background of advancements in the complex capabilities of the image-forming apparatus, the place where the discharged sheet is loaded or ejected can be selected for every use or every user. In many cases, multiple sheet discharge trays are provided.

Japanese Patent Application Publication No. 2001-63898 (hereinafter referred to as Document 1), Japanese Patent Application Publication No. 2001-109211 (hereinafter referred to as Document 2), and Japanese Patent Application Publication No. 2002-308511 (hereinafter referred to as Document 3) propose improvements in the sheet discharge unit, which is arranged between the image-reading unit and the image-forming unit in the image-forming apparatus.

Document 1 describes an image-forming device having a space part formed by an image-reading part and an image-forming part. A sheet on which an image is formed is discharged onto the space part. The proposals of Document 1 are improvements in the visibility and the easy take out of the discharged sheet. Specifically, the multiple trays for storing the discharged sheets are inclined to be lowered on the sheet discharge direction tip side.

Document 2 describes the image forming device having a main body and an optical unit. Even if the optional unit is attached on a space between the main body and the optical unit, the space on a sheet receiving tray is not narrowed. Specifically, the optical unit and the main body can be separated. Positioning members to determine attachment positions in a horizontal direction are respectively provided on the main body and the optical unit so that the optional unit can be attached between the optical unit and the main body.

Document 3 proposes to stack a large number of sheets on a second delivery sheet stacking means. Specifically, the second delivery sheet stacking tray, which is provided above a first delivery sheet stacking tray, is supported by two side walls.

Proposals made by the above-mentioned Documents 1 through 3 commonly include multiple paper receiving trays or sheet stacking trays, which are provided above and below in a layer structure. Arrangements and attachment methods of the above-mentioned layer structure are different according to the purpose. However, the proposals of the Documents 1 through 3 also include a common mechanism, in which sheets pass through a fixing device provided below and discharge rollers provided one above the other. Then, the sheets of papers are sorted into the paper receiving trays and sheet stacking trays. In addition, the paper receiving trays or sheet stacking trays are provided in a layer structure one above the other and parallel to each other, and have common attachment angles and curvatures.

In the fixing device described in each of the above-mentioned Documents 1 through 3, a toner image is transferred to a sheet. The sheet passes between a heating roll and a pressure roll and heat and pressure are applied to the sheet. Toner is melted by heat and pressed on the sheet. Thus, fixing is completed. The sheet, having passed through the fixing device, is heated and easy to get rolled, after passing through the rolls in the fixing device. In particular, the sheet gets curled easily when discharged from a discharge roll provided closest to the fixing device, namely, the discharge roll arranged immediately above the fixing device. A description will be given of the curled sheet with reference to FIG. 1.

FIG. 1 schematically illustrates a sheet discharge portion. The sheet discharge portion includes discharge rolls 101, 102, and 103, provided above a fixing unit 100. The discharge rolls 101, 102, and 103 are arranged from the bottom. As is obvious from FIG. 1, a largest shoot curvature is a shoot curvature $\rho 3$ of the sheet discharged from the discharge roll 103, which is provided furthest from the fixing unit 100. A second largest shoot curvature is a shoot curvature $\rho 2$ of the sheet discharged from the discharge roll 102. The smallest shoot curvature is a shoot curvature $\rho 1$ of the sheet discharged from the discharge roll 101, which is provided closest to and immediately above the fixing unit 100.

The sheet discharged from the discharge roll 101 passes through the fixing unit 100, and is loaded onto a sheet-receiving unit 104 in a shortest time. The sheet-receiving unit 104 has a shortest path from the fixing unit 100. In this case, the shortest time is allowed for cooling down the heat applied to the sheet when the sheet passes through the fixing unit 100. In addition to the smallest shoot curvature $\rho 1$ when the sheet passes through the discharge roll 101, the sheet discharged from the discharge roll 101 gets curled most easily, and the sheet loaded onto the sheet-receiving unit 104 gets curled easily as a roll.

As described above, if the discharged sheet is curled, a stacking state on the sheet-receiving unit will adversely be affected. As examples of adverse affects, the discharged sheets are not piled up uniformly, or the sheets already loaded on the sheet-receiving unit are sequentially pushed out by the sheets newly discharged one by one.

Proposals made by Documents 1 through 3 commonly include multiple paper receiving trays or sheet stacking trays, which are provided above and below in a layer structure. Arrangements and attachment methods of the above-mentioned layer structure are different according to the purpose. However, the proposals of the Documents 1 through 3 are not made to solve the above-mentioned problem, that is, the discharged sheet easily gets curled. Proposals made by Documents 1 through 3 do not intend to solve the problem of the curled discharge sheet.

SUMMARY OF THE INVENTION

The present invention has been made in view of the above circumstances and provides an image-forming apparatus that can prevent a sheet of paper having passed through a fixing unit from getting curled and prevent a stacking state of discharged sheets from degrading.

According to one aspect of the present invention, there is provided an image-forming apparatus includes multiple sheet discharge trays arranged on a downstream of a fixing unit in a layer structure, and multiple sheet-receiving units provided corresponding to the multiple sheet discharge trays arranged in the layer structure. Each of the sheet-receiving units respectively includes a climbing slope from a sheet discharge direction start point to a sheet discharge direction end point, and an angle of the climbing slope of a sheet-receiving unit is close to plane, as the sheet-receiving unit is arranged on a further downstream.

According to another aspect of the present invention, there is provided an image-forming apparatus includes multiple sheet discharge trays arranged on a downstream of a fixing unit in a layer structure, and multiple sheet-receiving units provided corresponding to the multiple sheet discharge trays arranged in the layer structure. Each of the sheet-receiving units respectively includes a climbing slope from a sheet discharge direction start point to a sheet discharge direction end point, and an angle of the climbing slope of a sheet-receiving unit is greater, as the sheet-receiving unit is arranged on a lower layer.

According to another aspect of the present invention, there is provided an image-forming apparatus includes multiple sheet discharge trays arranged on a downstream of a fixing unit in a layer structure, and multiple sheet-receiving units provided corresponding to the multiple sheet discharge trays arranged in the layer structure. Each of the sheet-receiving units respectively includes a climbing slope from a sheet discharge direction start point to a sheet discharge direction end point, and an angle of the climbing slope on the sheet discharge direction end point is close to plane, as a sheet-receiving unit is arranged on a further downstream.

According to another aspect of the present invention, there is provided an image-forming apparatus includes multiple sheet discharge trays arranged on a downstream of a fixing unit in a layer structure, and multiple sheet-receiving units provided corresponding to the multiple sheet discharge trays arranged in the layer structure. Each of the sheet-receiving units respectively includes a climbing slope from a sheet discharge direction start point to a sheet discharge direction end point, and an angle of the climbing slope on the sheet discharge direction start point is greater, as a sheet-receiving unit is arranged on a lower layer.

According to another aspect of the present invention, there is provided a sheet discharge tray that forms a sheet-receiving unit in an image-forming apparatus comprising a climbing slope from a sheet discharge direction start point to a sheet discharge direction end point. The sheet discharge direction end point is formed by a variable tray having a supporting portion provided on a side of the sheet discharge direction start point.

According to another aspect of the present invention, there is provided an image-forming apparatus comprising a sheet discharge tray that forms a sheet-receiving unit. The sheet discharge tray includes a climbing slope from a sheet discharge direction start point to a sheet discharge direction end point, and the sheet discharge direction end point is formed by a variable tray having a supporting portion provided on a side of the sheet discharge direction start point.

According to another aspect of the present invention, there is provided a sheet discharge mechanism includes a fixing unit that fixes an image on a sheet, a first sheet discharge unit provided on a downstream of the fixing unit, a second sheet discharge unit provided on the downstream of the fixing unit and arranged further than the first sheet discharge unit, a first sheet-receiving unit that receives a discharged sheet from the first sheet discharge unit, and a second sheet-receiving unit that receives the discharged sheet from the second sheet discharge unit. A climbing angle of the second sheet-receiving unit is closer to plane than the climbing angle of the first sheet-receiving unit.

BRIEF DESCRIPTION OF THE DRAWINGS

Embodiments of the present invention will be described in detail based on the following figures, wherein.

DESCRIPTION OF THE EMBODIMENTS

A description will now be given, with reference to the accompanying drawings, of embodiments of the present invention.

First Embodiment

Figure 1:
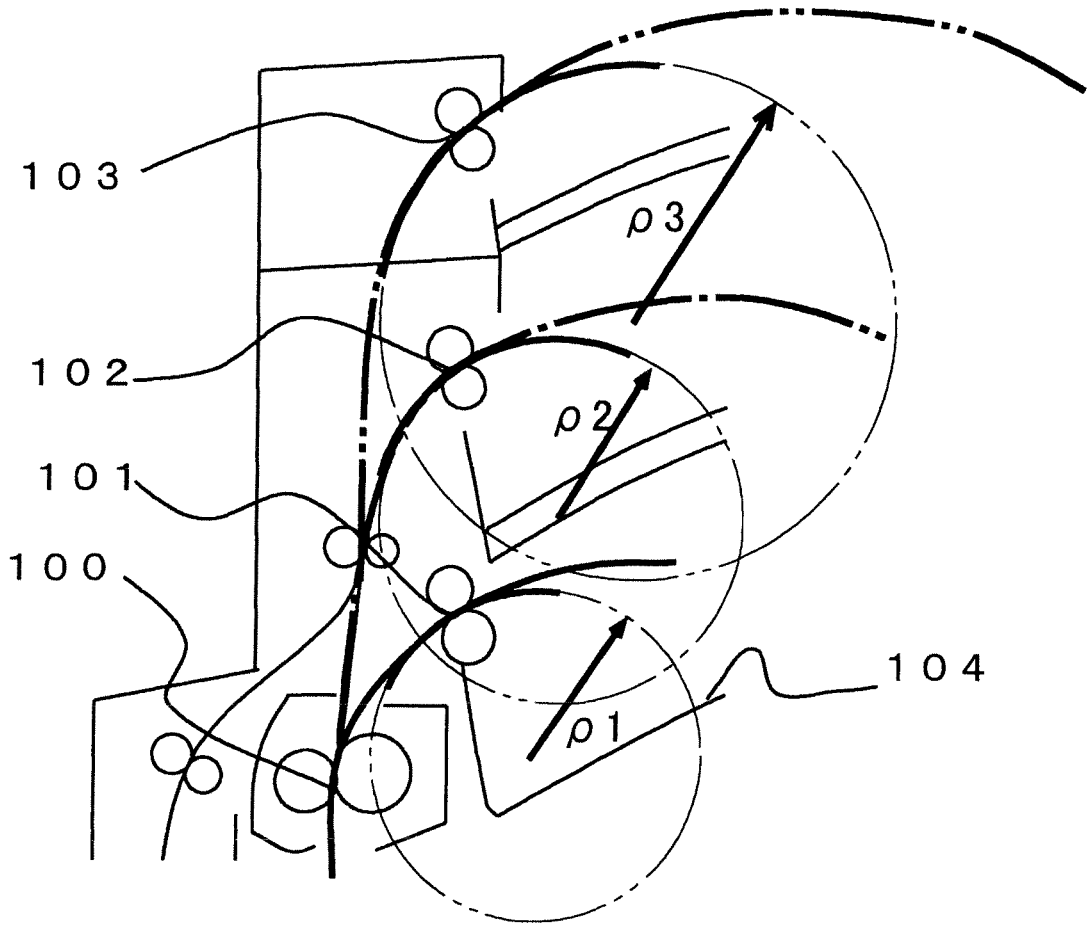
FIG. 1 illustrates differences in shoot curvatures of multiple sheet-receiving units.
Figure 2:
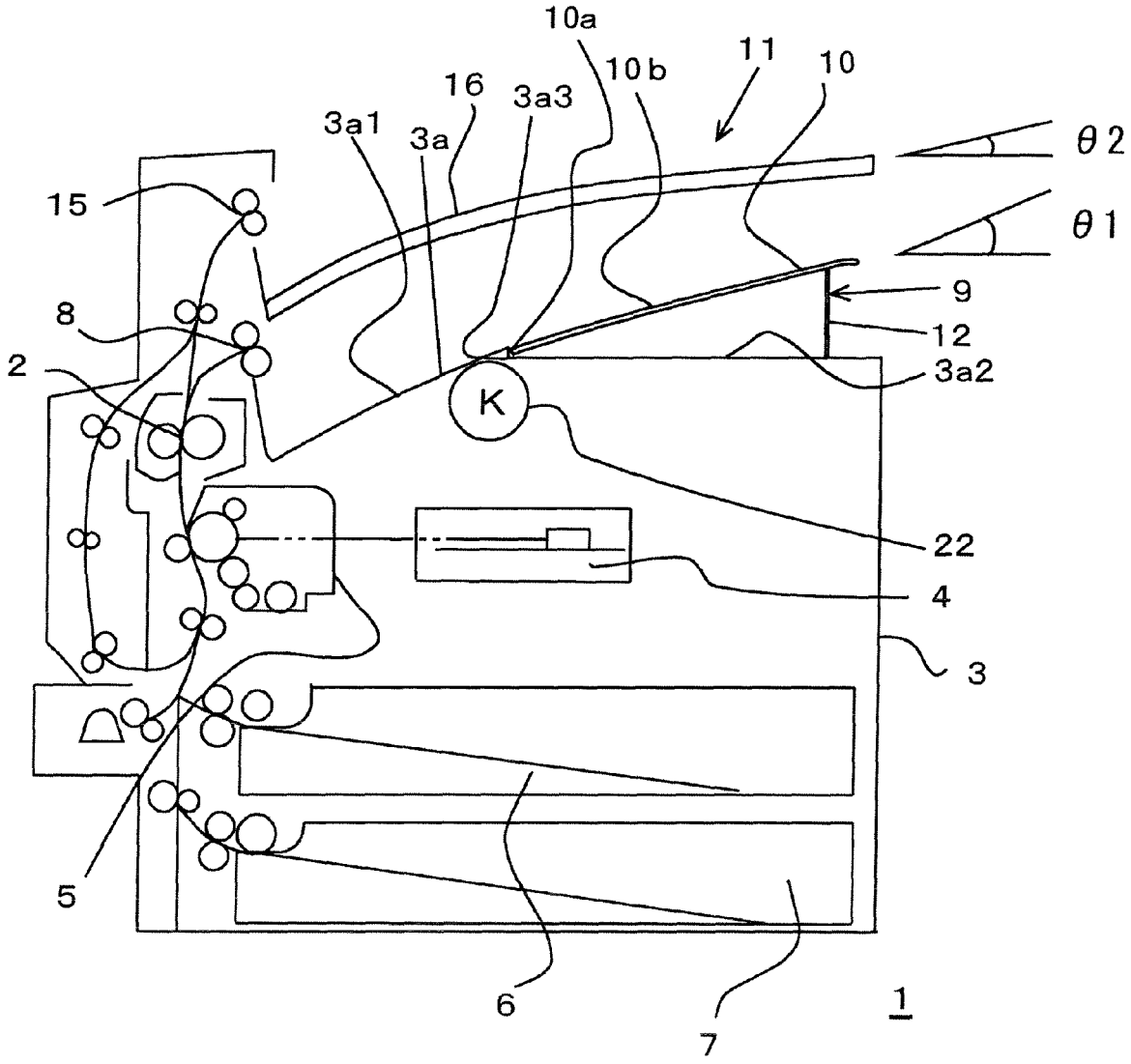
FIG. 2 schematically illustrates the image-forming apparatus having two sheet-receiving units in a two-layered structure.
Figure 3:
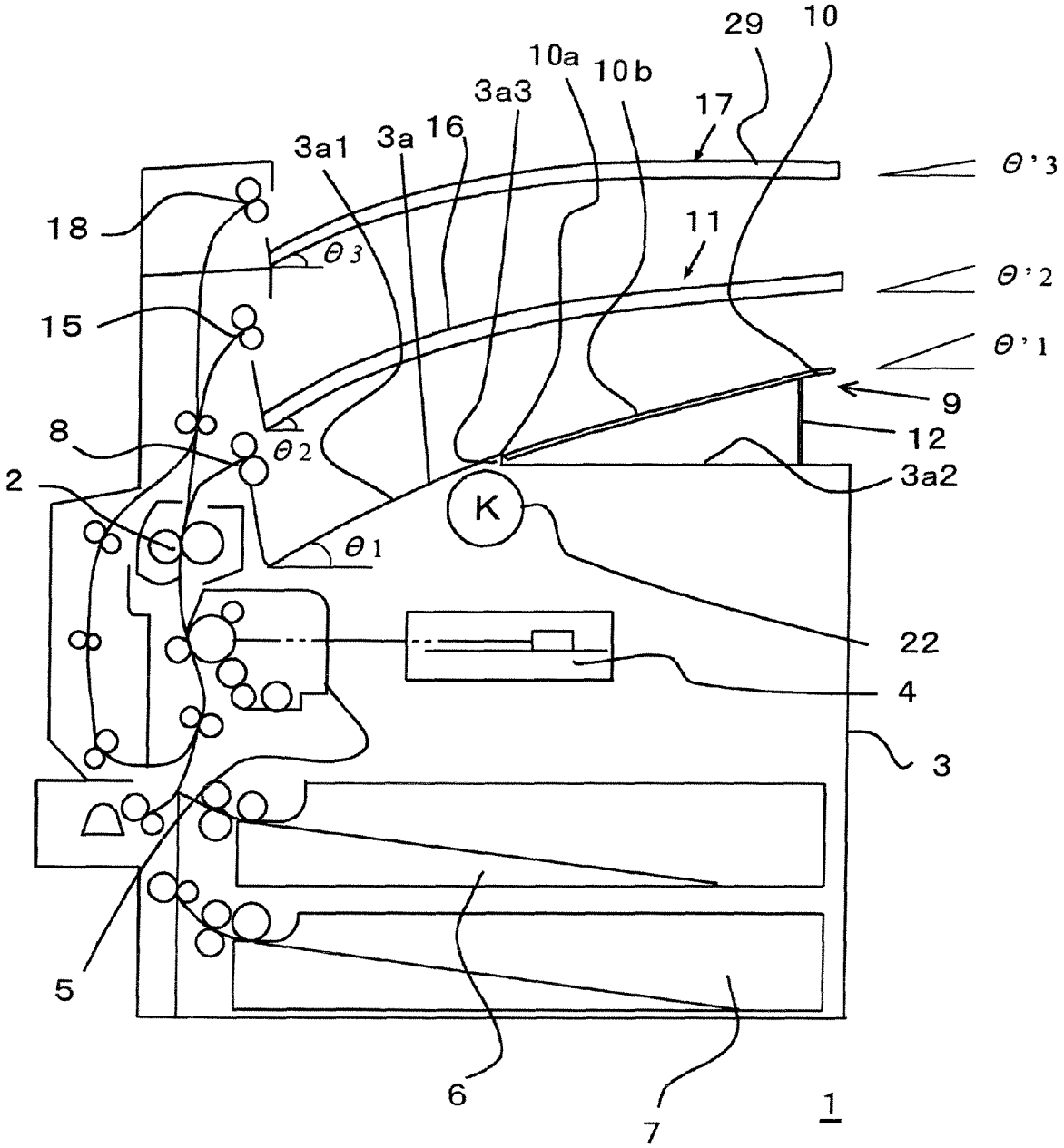
FIG. 3 schematically illustrates the image-forming apparatus having three sheet-receiving units in a three-layered structure.
Figure 4:
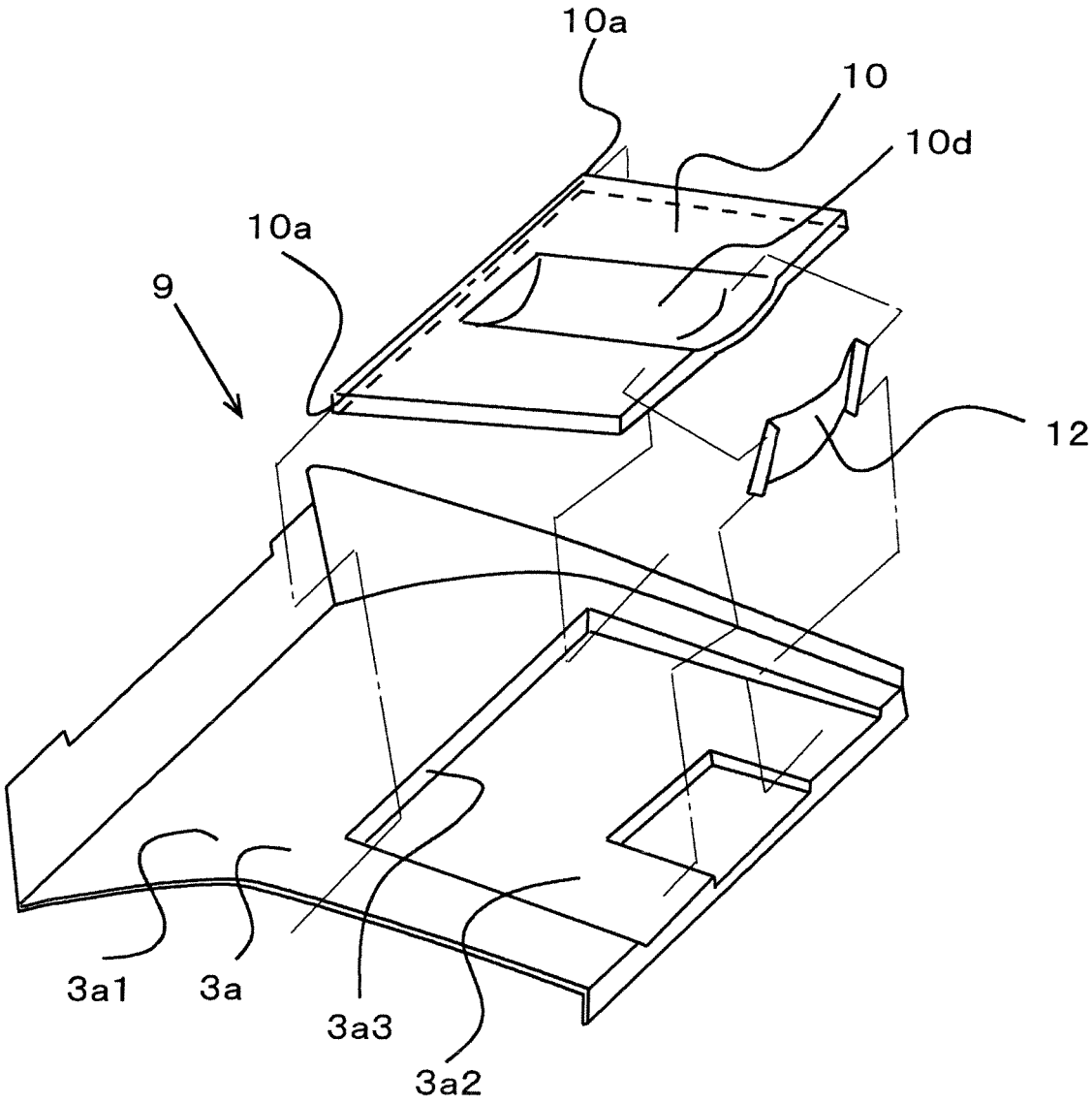
FIG. 4 is an exploded perspective view of a first sheet-receiving unit.

A description will be given of an image-forming apparatus 1 in accordance with the present invention, with reference to FIGS. 2 through 5. FIG. 2 schematically illustrates the image-forming apparatus 1 having two sheet-receiving units in a two-layered structure. FIG. 3 schematically illustrates the image-forming apparatus 1 having three sheet-receiving units in a three-layered structure. FIG. 4 is an exploded perspective view of a first receiving unit provided in an undermost layer. An image-reading unit, not shown, is provided above the image-forming unit.

A fixing unit 2 is arranged in a container box 3. Additionally, the container box 3 includes a photolithography machine 4, an image-forming unit 5, sheet feeding trays 6 and 7, a first discharge roller 8, and a black (K) toner cartridge 22. In the container box 3, a top board 3*a* forms a first sheet-receiving unit 9, as shown in FIG. 2. The top board 3*a* includes a slope portion 3*a*1, a plane surface portion 3*a*2, and a step portion 3*a*3. The slope portion 3*a*1 is arranged on a side of a sheet discharge direction start point. The plane surface portion 3*a*2 is arranged on a side of a sheet discharge direction end point. The step portion 3*a*3 is arranged on a point that connects the slope portion 3*a*1 and the plane surface portion 3*a*2.

A variable tray 10 is arranged on the top board 3*a* to overlap the plane surface portion 3*a*2. The variable tray 10 serves as a sheet-discharge tray. A supporting point 10*a* of the variable tray 10 is arranged on the side of the sheet discharge direction start point to correspond the supporting point 10*a* to the step portion 3*a*3. Thus, a top surface 10*b* of the variable tray forms a continuous surface from the slope portion 3*a*1, which is provided on the top board 3*a*. This continuous surface forms a climbing slope.

Figure 5:
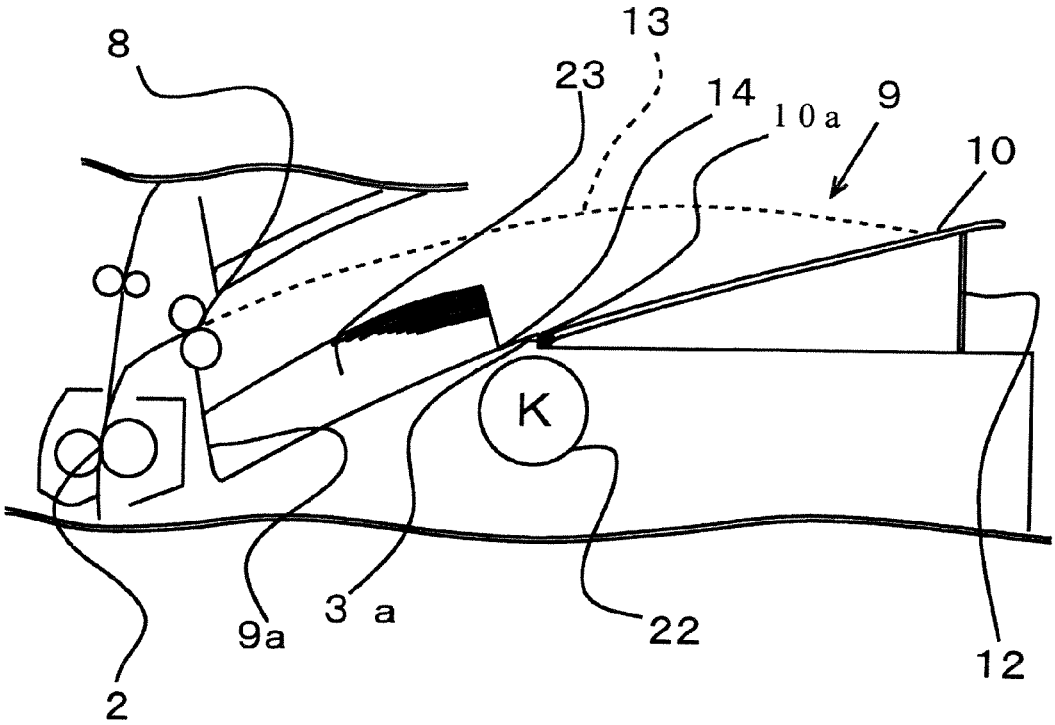
FIG. 5 illustrates a supporting point of a variable tray.

Referring to FIG. 5, the supporting point 10*a* of the variable tray 10 is provided apart from a sheet discharge direction start point 9*a* of the first sheet-receiving unit 9 by at least half as long as a discharge direction length of a largest sheet size, on which an image is intended to be formed. For example, in the case where a long side of an A3 size sheet is intended, a half of the discharge direction length of the largest sheet size corresponds to a short side of an A4 size sheet. A dotted line 13 in FIG. 5 shows a trace drawn by a front edge of the discharge direction of the A3 size sheet, in which the discharge direction is the long side of the A3 size sheet. A reference numeral 14 denotes a point apart from the sheet discharge direction start point 9*a* by the length of the short side of an A4 size sheet 23. As described, the supporting point 10*a* of the variable tray 10 is provided apart from the sheet discharge direction start point 9*a* of the first sheet-receiving unit 9 by at least half as long as the discharge direction length of the largest sheet size, on which an image is intended to be formed by the image-forming apparatus 1. A first sheet discharge unit provided on a downstream of the fixing unit 2 corresponds to the first discharge roller 8. A first sheet discharge unit includes the first discharge roller 8 and the first-sheet receiving unit 9. The first discharge roller 8 is arranged on the downstream of the fixing unit 2.

The variable tray 10 is capable of moving with the supporting point 10*a*. However, a stopper 12 supports the variable tray 10 so that the variable tray 10 can maintain a given angle on the side of sheet discharge direction end point. The angle of the variable tray 10 can be changed in phases by changing the height of the stopper 12 or the position to be supported. Referring to FIG. 4, the variable tray 10 includes a concave slope 10*d* on the sheet discharge direction end point.

The image-forming apparatus 1 includes a second sheet discharge unit provided on the downstream of the fixing unit 2 and arranged above the first discharge roller 8. The second sheet discharge unit includes a second discharged roller 15 and a second sheet discharge tray 16, and the sheet discharged from the second discharged roller 15 is piled up on the sheet discharge tray 16. As shown in FIG. 2, the second sheet discharge unit forms a second sheet-receiving unit 11 having a climbing slope.

Here, an angle θ1>an angle θ2. The angle θ1 denotes an angle of the sheet discharge direction start point of the climbing slope in the first sheet-receiving unit 9. The angle θ2 denotes the angle of the sheet discharge direction start point of the climbing slope in the first sheet-receiving unit 11.

The angle θ1 and the angle θ2 also denotes average angles of the climbing slope of the first and the second sheet-receiving units respectively in accordance with the first embodiment of the present invention.

Referring to FIG. 3, the image-forming apparatus 1 may include a third sheet discharge unit is provided on the downstream of the fixing unit 2 and is arranged above the second sheet-receiving unit 11. The third sheet discharge unit includes a third discharge roller 18 and a third discharge tray 29. The sheet discharged from the third discharge roller 18 is stacked on the third discharge tray 29. The third sheet discharge unit forms a third sheet-receiving unit 17 having a climbing slope.

In the case where three sheet-receiving units having a three-layered structure are provided, the angle θ1>the angle θ2>an angle θ3 is satisfied. The angle θ1 denotes the angle of the sheet discharge direction start point of the climbing slope in the first sheet-receiving unit 9. The angle θ2 denotes the angle of the sheet discharge direction start point of the climbing slope in the first sheet-receiving unit 11. The angle θ3 denotes an angle of the sheet discharge direction start point of the climbing slope in the first sheet-receiving unit 17.

A description will be given of how a sheet of paper is discharged in thus configured image-forming apparatus 1. The shoot curvature appears in sheets discharged onto the first sheet-receiving unit 9, which is the closest to the fixing unit 2. Thus, a description will be given of sheets of paper discharged onto the first sheet-receiving unit 9.

Figure 6:
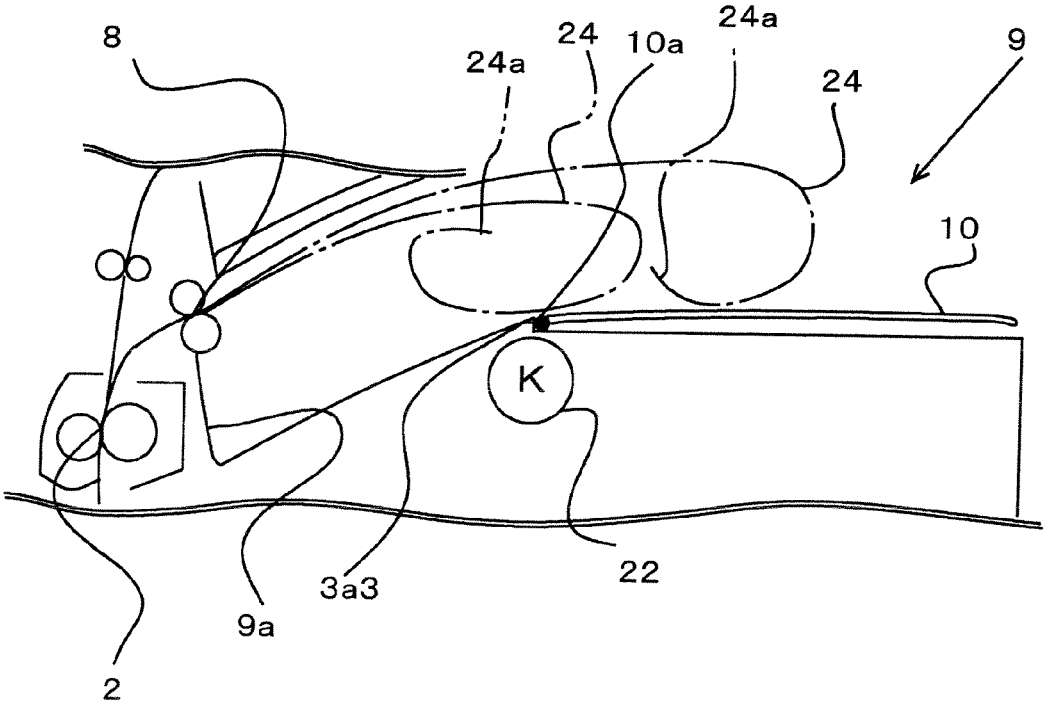
FIG. 6 illustrates sheets of paper discharged onto the variable tray in a standing state and the font edges of the discharge direction of the discharged sheets get curled and are piled up on the first sheet-receiving unit.
Figure 7:
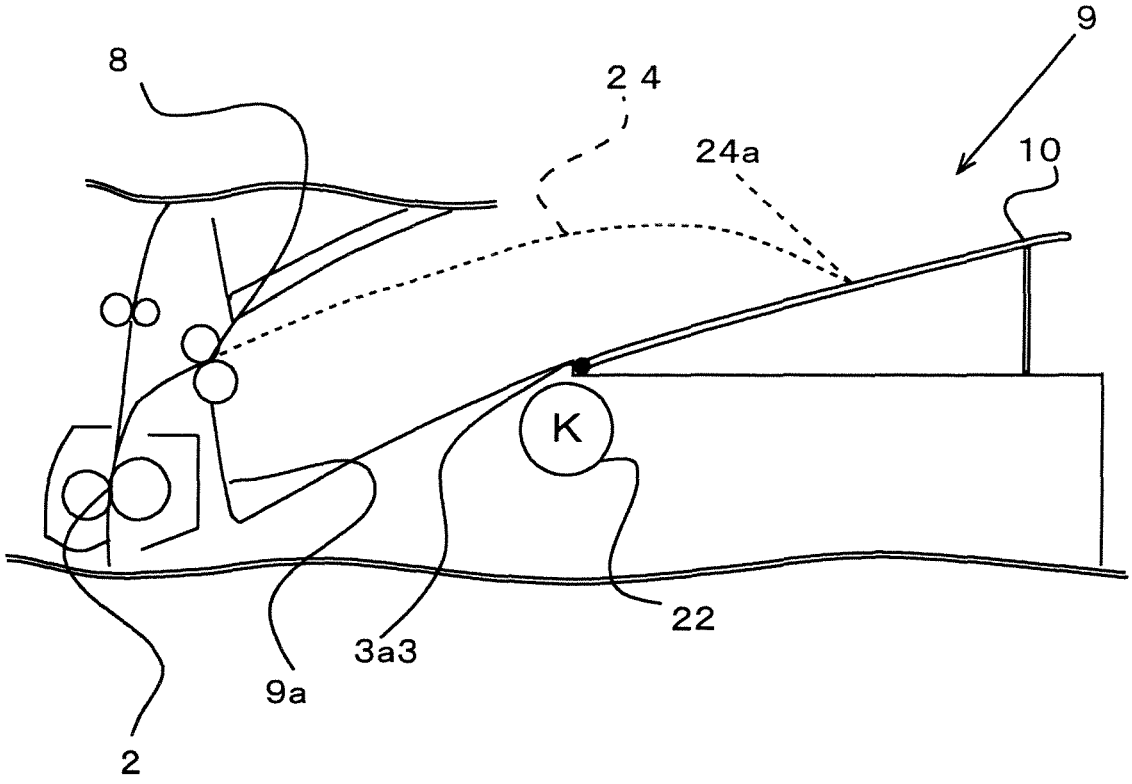
FIG. 7 illustrates how the sheet is discharged onto the variable tray in a standing state.

FIG. 6 illustrates sheets of paper 24, which are discharged and piled up on the first sheet-receiving unit 9 having the variable tray 10 in a down state. Front edges of the discharge direction 24*a* of the sheets of paper 24 are curled. On the other hand, FIG. 7 illustrates the sheet of paper discharged on the variable tray 10 in a standing state.

First, the discharged sheet 24 touches the variable tray 10 with the front edge of the discharge direction 24*a*. When comparing the times in FIGS. 6 and 7, the time and a distance are longer in FIG. 6 until the front edge of the discharge direction 24*a* gets into touch with the variable tray 10. Therefore, the front edge of the discharge direction 24*a* gets curled before reaching the variable tray 10. In contrast, in FIG. 7, the front edge of the discharge direction 24*a* gets into touch with the variable tray 10 before the front edge of the discharge direction 24*a* gets curled completely. The sheet 24 is loaded on the first sheet-receiving unit 9 without being curled.

The front edge of the discharge direction 24*a* of the sheet 24 gets curled when affected by various conditions such as sheet size or the like. The angle of the variable tray 10 is controlled by adjusting the height of the stopper 12 so that the sheet 24 is loaded without getting curled.

Figure 8:
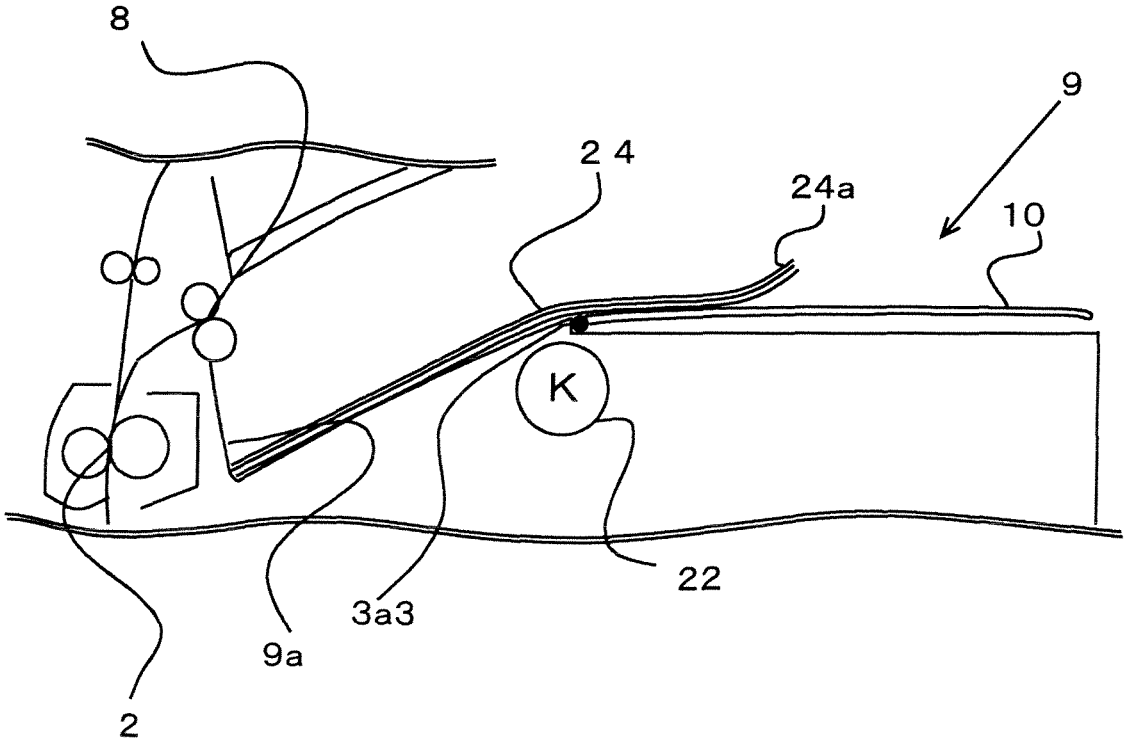
FIG. 8 illustrates the sheets of paper and the font edges of the discharge direction are getting curled upwardly.
Figure 9:
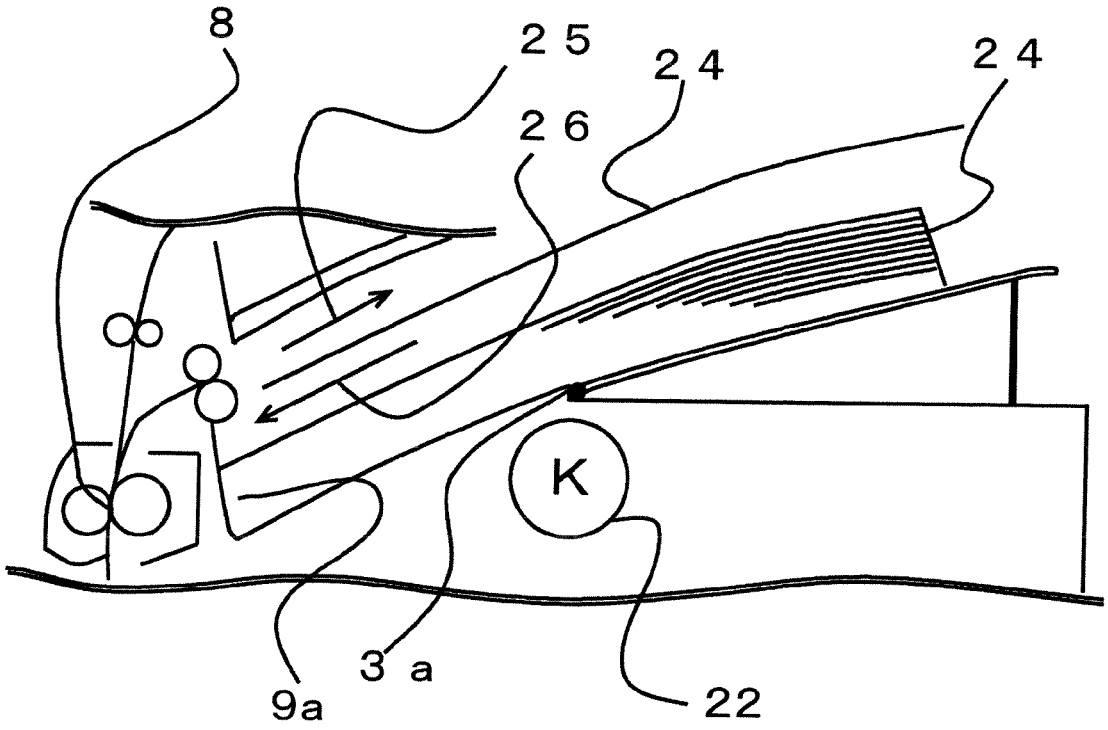
FIG. 9 illustrates the discharged sheets are aligned on the sheet-receiving unit.

The front edge of the discharge direction 24*a* of the sheet 24 gets curled upwardly, in some cases. In this case, referring to FIG. 8, the variable tray 10 is made in the down state. That is to say, the sheets of paper 24 piled on the first sheet-receiving unit 9 have convex shapes around the supporting point 10*a* of the variable tray 10 and do not get curled any longer.

The sheets of paper 24 are discharged from the first discharge roller 8 in a direction of an arrow 25, get into touch with a wall surface 9*a* moving to a direction of an arrow 26, and are piled up on the first sheet-receiving unit 9 in an alignment. The piled sheets 24 can be taken out by inserting the hand into the concave slope 10*d* of the variable tray 10.

As shown in FIG. 3, the sheet-receiving units are configured in the three-layered structure to satisfy the angle θ1>the angle θ2>the angle θ3. However, the angle θ1>the angle θ2=the angle θ3 may be satisfied so that the second sheet-receiving unit and the third sheet-receiving unit may have the same angle. On the second sheet-receiving unit and the third sheet-receiving unit, the sheets easily get curled. A sheet discharge mechanism includes the first through third sheet discharge units and the first through third sheet-receiving units.

As shown in FIG. 3, an angle θ'1>an angle θ'2 may be satisfied. The angle θ'1 denotes an angle of the sheet discharge direction end point of the climbing slope in the first sheet-receiving unit 9. The angle θ'2 denotes the angle of the sheet discharge direction end point of the climbing slope in the first sheet-receiving unit 11. As shown in FIG. 4, the angle θ'1>the angle θ'2>an angle θ'3 or the angle θ'1>the angle θ'2=the angle θ'3 may be satisfied. The angle θ'1 denotes the angle of the sheet discharge direction end point of the climbing slope in the first sheet-receiving unit 9. The angle θ'2 denotes the angle of the sheet discharge direction end point of the climbing slope in the first sheet-receiving unit 11. The angle θ'3 denotes an angle an angle of the sheet discharge direction end point of the climbing slope in the first sheet-receiving unit 17.

Second Embodiment

Next, a description will be given of a second embodiment of the present invention. The image-forming apparatus 1 includes the variable tray 10 supported by the stopper 12 in accordance with the first embodiment of the present invention. However, the variable tray 10 is elastically supported by an elastic member between the variable tray 10 and the plane surface portion 3*a*2 in accordance with the second embodiment of the present invention.

Figure 10:
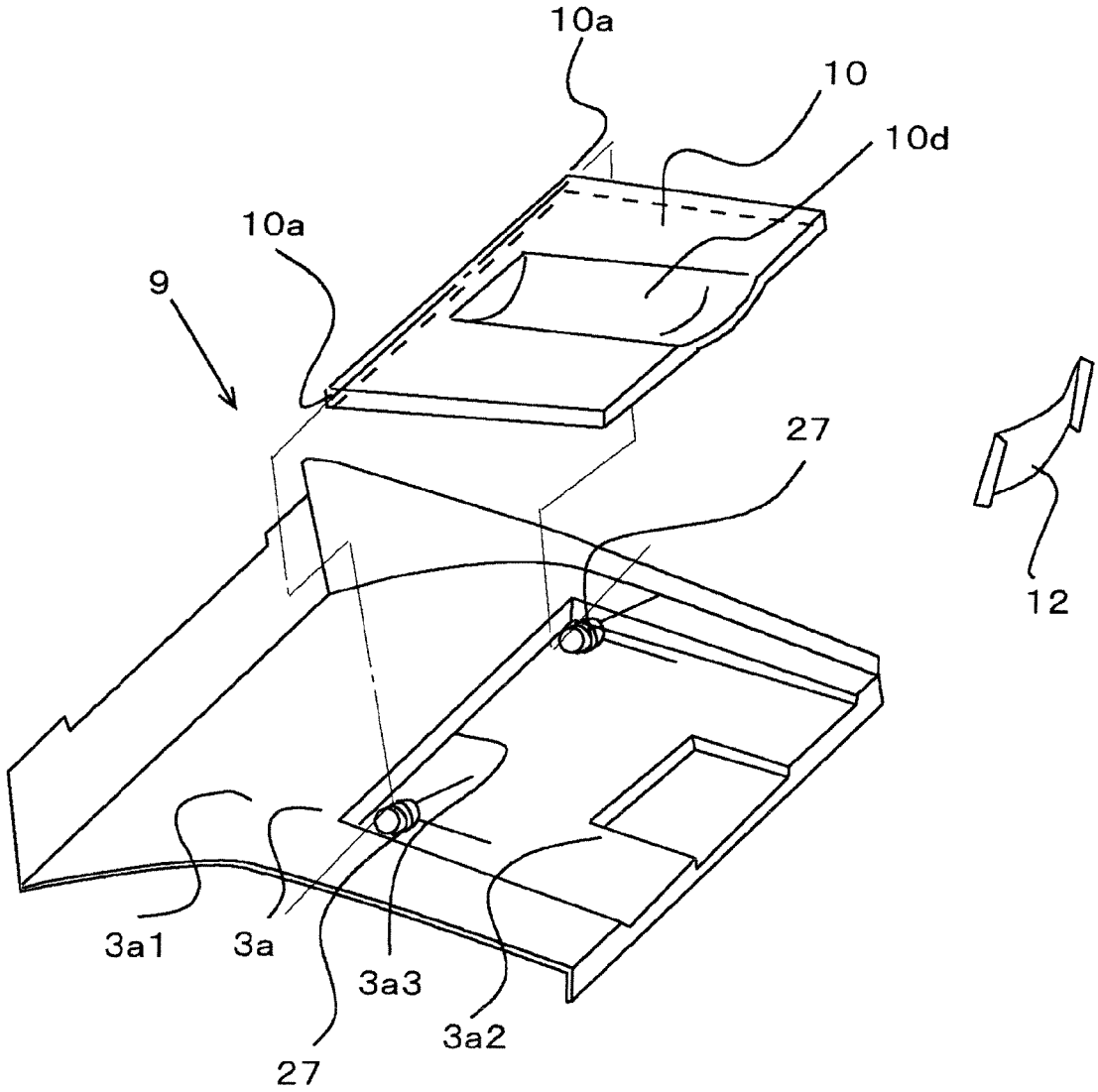
FIG. 10 is an exploded perspective view of the first sheet-receiving unit having a torsion spring to support the variable tray.
Figure 11:
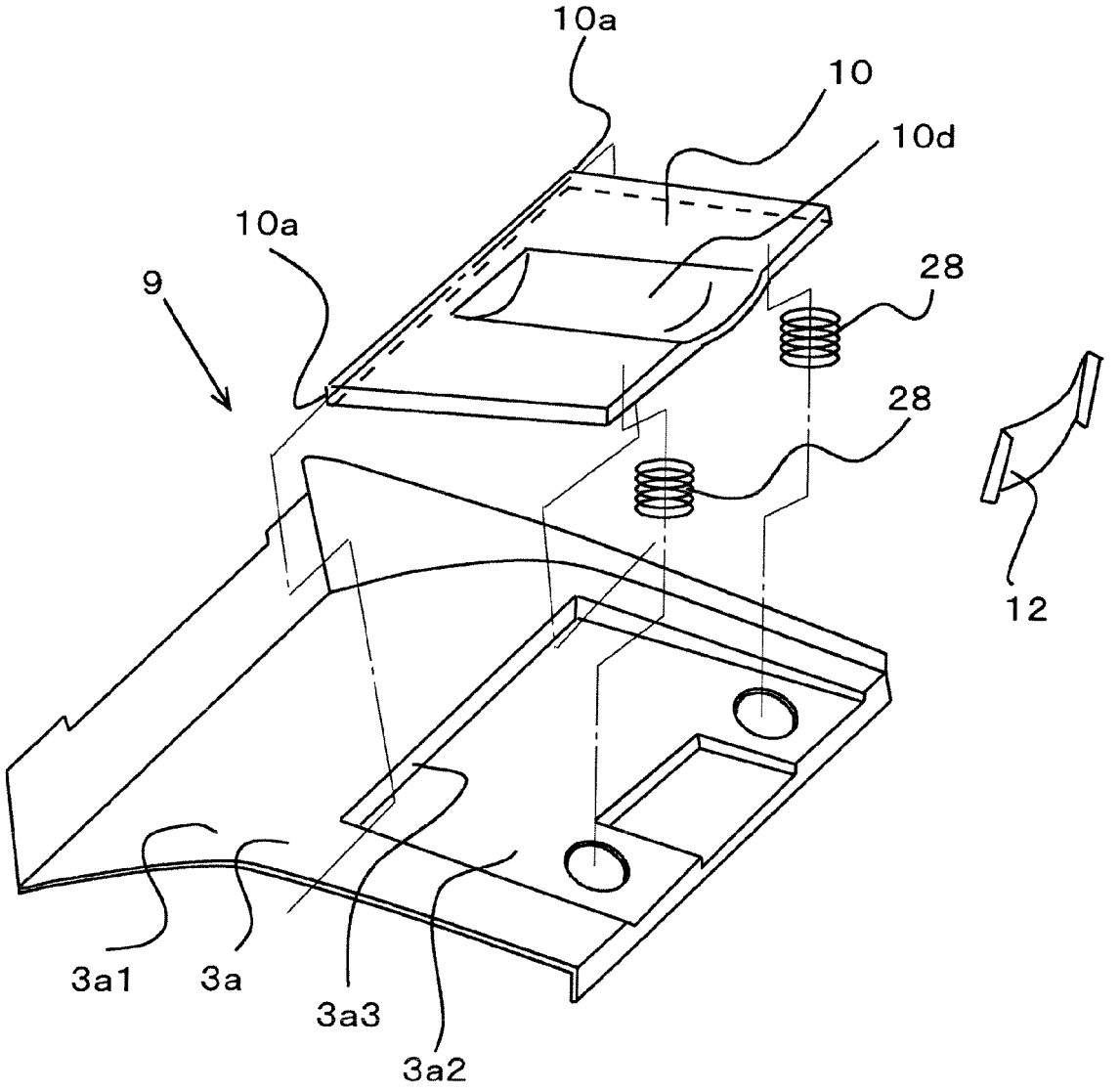
FIG. 11 is an exploded perspective view of the first sheet-receiving unit having a compression spring to support the variable tray.

Referring to FIG. 10, a torsion spring 27 may be used for the elastic member. Referring to FIG. 11, a compression spring 28 may be used. The variable tray 10 may be supported by both the elastic member and the stopper 12.

As shown in FIGS. 2 and 3, the second sheet-receiving unit 11 is provided above the first sheet-receiving unit 9. Therefore, a gap is narrow between the first sheet-receiving unit 9 and the second sheet-receiving unit 11. However, in the case where the above-mentioned elastic member is provided, multiple sheets are piled up on the variable tray 10, and the variable tray 10 gradually becomes inclined to be in the down state. When the variable tray 10 is in the down state, the gap becomes wider between the first sheet-receiving unit 9 and the second sheet-receiving unit 11, more sheets of paper can be piled up on the first sheet-receiving unit 9, and in addition, it is easy to take out the sheets stacked on the first sheet-receiving unit 9.

In the above-mentioned case, the variable tray 10 gradually becomes in the down state. However, the discharged sheets are stacked, and the surface of an uppermost discharged sheet is loaded close to the discharge roller 8. The front edge of the discharge direction of the discharged sheet is capable of being piled up on the uppermost discharged sheet before getting curled. The effect of the present invention is not damaged.

Third Embodiment

Figure 12:
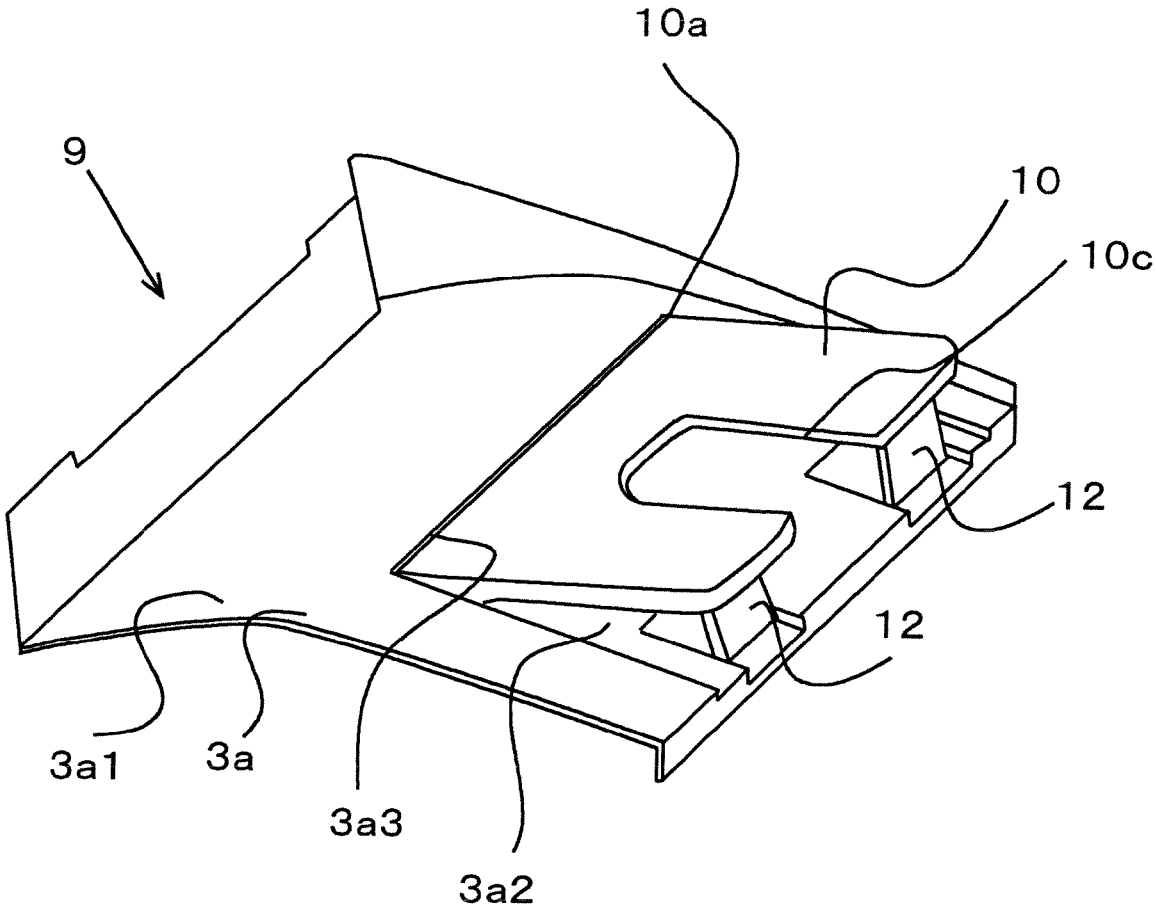
FIG. 12 is a perspective view of the first sheet-receiving unit including the variable tray with a cutout portion.

Next, a description will be given of a third embodiment of the present invention. As shown in FIG. 4, the image-forming apparatus 1 includes the variable tray 10 having the concave slope 10*d* on the side of the sheet discharge direction end point. However, referring to FIG. 12, instead of the concave slope 10*d*, a cutout portion 10*c* is included in accordance with the third embodiment of the present invention. The stopper 12 has a shape different from that of the first embodiment of the present invention.

With the above-mentioned configuration, it is easy to inset the hand into a space between the plane surface portion 3*a*2 and the variable tray 10, and it is easy to take out the sheet.

Fourth Embodiment

Next, a description will be given of a fourth embodiment of the present invention, with reference to FIG. 13. The image-forming apparatus 1 includes the black (K) toner cartridge 22 below the step portion 3*a*3 in accordance with the first embodiment of the present invention. In addition to the black (K) toner cartridge 22, three toner cartridges are included below the step portion 3*a*3 in accordance with the fourth embodiment of the present invention. The three toner cartridges are a yellow (Y) toner cartridge 19, a magenta (M) toner cartridge 20, and a cyan (C) toner cartridge 21. The three toner cartridges of yellow (Y), magenta (M), and cyan (C) have diameters smaller then that of the black (K) toner cartridge 22.

The image-forming apparatus 1 in accordance with the fourth embodiment of the present invention includes the container box 3 in which the fixing unit 2 is housed. The container box 3 includes the plane surface portion 3*a*2 provided on the top board 3*a* so that the variable tray 10 can be provided on the plane surface portion 3*a*2. Therefore, a capacity of the container box 3 is decreased by the plane surface portion 3*a*2, and the space inside the container box 3 is limited.

The three toner cartridges of the yellow (Y) toner cartridge 19, the magenta (M) toner cartridge 20, and the cyan (C) toner cartridge 21 having diameters smaller than that of the black (K) toner cartridge 22 are mounted on the limited space as described above, and are intended to save the space of the image-forming apparatus 1, while preventing the sheet getting curled.

With the above-mentioned color image-forming apparatus having the above-mentioned color toner cartridges, the second embodiment and the third embodiment can be applied to the variable tray 10, in accordance with the fourth embodiment of the present invention.

Figure 13:
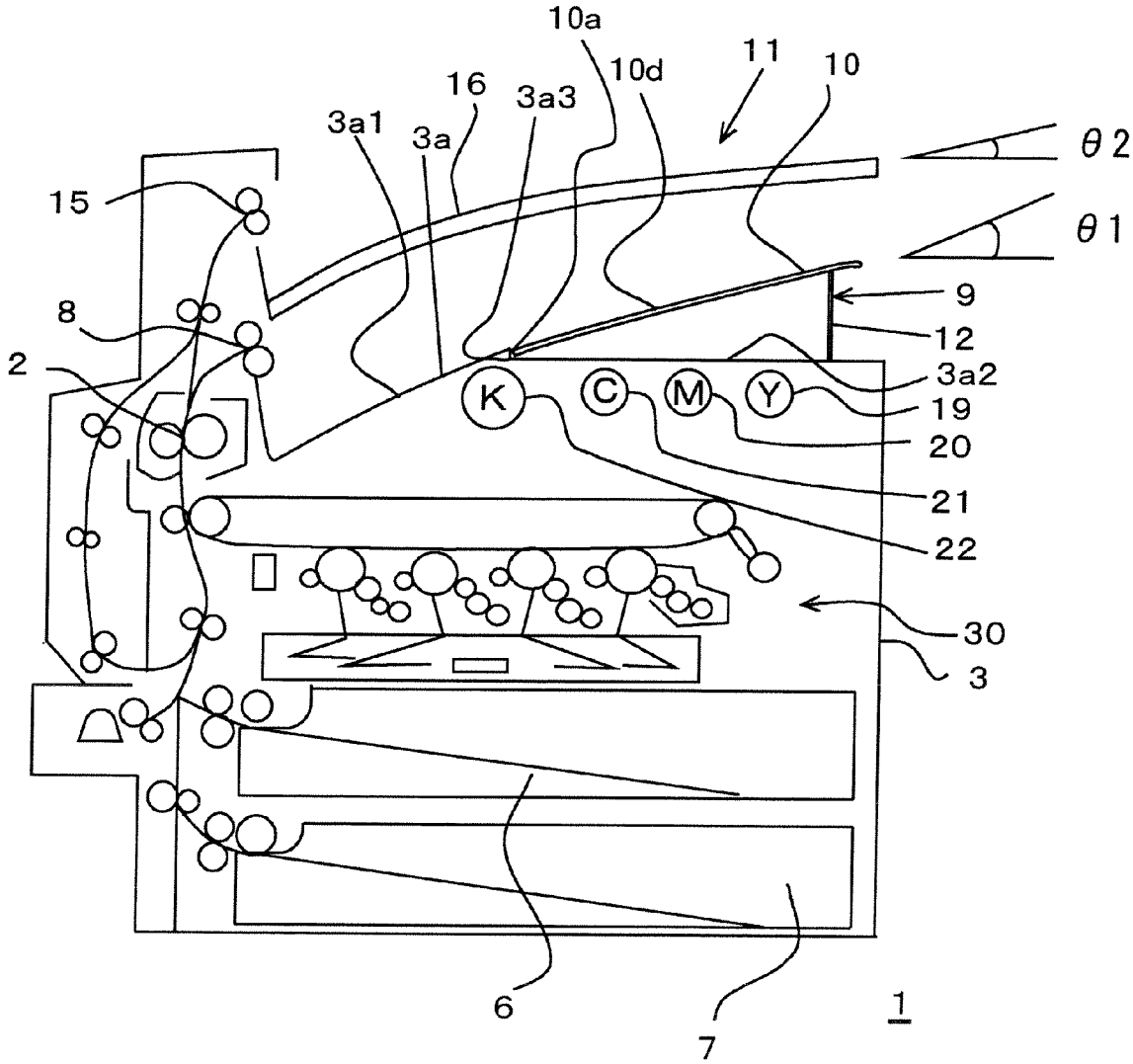
FIG. 13 schematically illustrates color toner cartridges below a plane surface portion inside a container box.

Referring to FIG. 13, an image-forming unit 30 is used for color printing, in accordance with the fourth embodiment of the present invention. In the fourth embodiment, the same components and configurations as those of the first embodiment have the same reference numerals and a detailed explanation will be omitted, if not otherwise specified.

Figure 14:
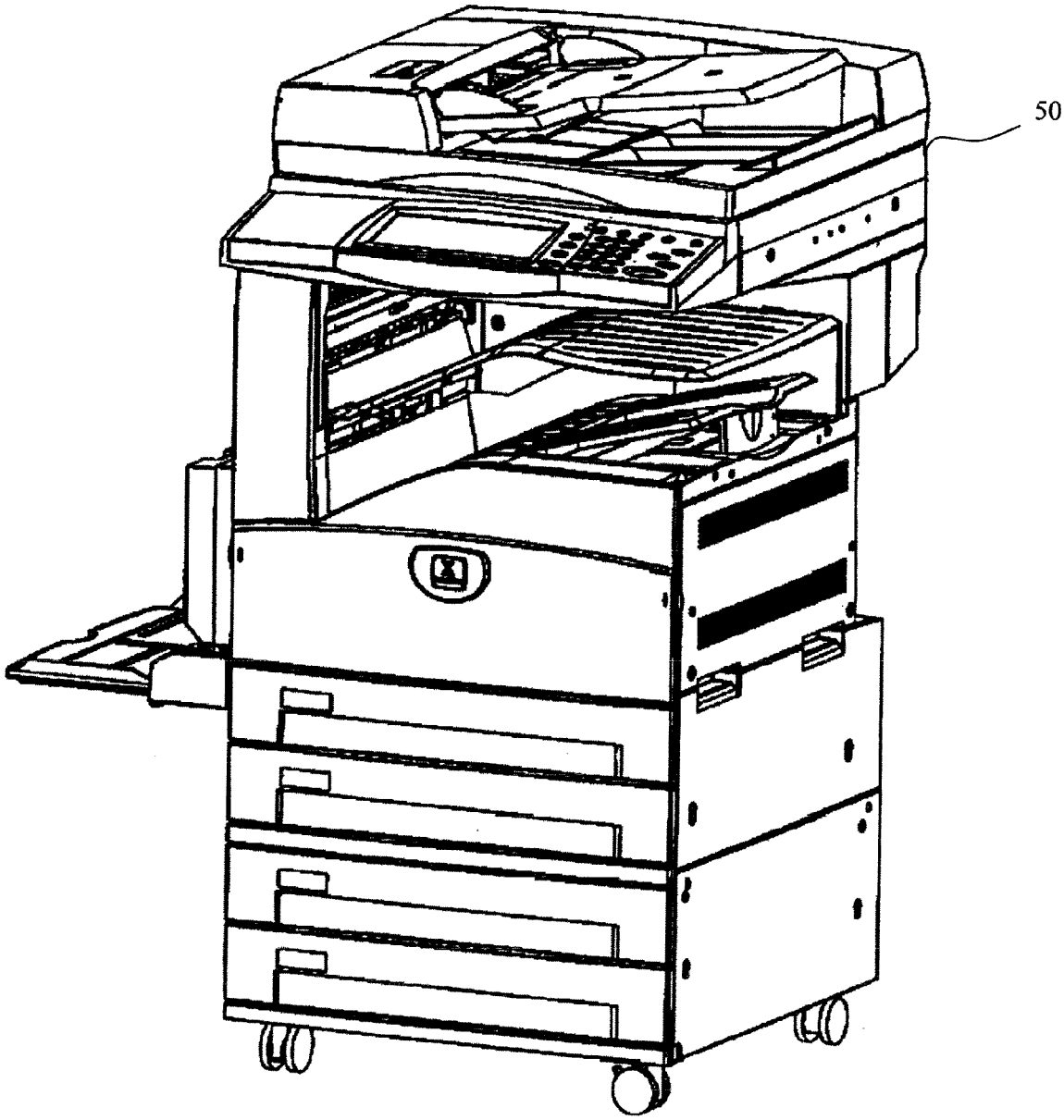
FIG. 14 shows an image-reading unit having an operation unit arranged above the sheet-receiving units.

With the above-mentioned image-forming apparatus 1 having the sheet-receiving unit, referring to FIG. 14, an image-reading unit 50 may be provided above the sheet-receiving units. The image-reading unit 50 is supported by supporting members from two sides so as to provide a given space between the second sheet-receiving unit 11. The image-reading unit 50 includes an operation unit having a display panel on a front face thereof. The display panel displays information necessary for operation and operation buttons. With the above-mentioned sheet-receiving units having angles described in the first through fourth embodiments of the present invention, it is possible to suppress the height of whole image-forming apparatus 1 and the operation unit, and provide excellent paper discharge capabilities, even in the case where the image-reading unit is arranged above the sheet discharge units.

In addition, in the case where the above-mentioned sheet-receiving units are arranged in a multiple layer structure, the layers are not limited to two layers, three or more layers may be arranged on the image-forming unit.

Further, the variable tray may be supported by oil pressure to vary and control the angle of the variable tray.

In accordance with the present invention, a front edge of the discharged sheet that is curled more or less is made to touch the top surface of the sheet-receiving unit as early as possible, in order to prevent the discharged sheet of paper from stacking on the sheet-receiving unit in a curled state. So, the sheet-receiving unit is configured to be in a more standing state, in the case where the discharged sheet of paper has a shorter cooling period, smaller shoot curvature, and in a more curled state. The sheet discharged from a discharge roller provided on a more downstream is cooled when the sheet is discharged, and is not easily curled after the sheet passes through a straight path toward the downstream. The sheet-receiving unit arranged in the upper layer does not have to be configured in the standing state, as compared to the sheet-receiving unit provided in the lower layer. Thus, the angle of the climbing slope provided in the lower layer is configured to be in a standing state, and the angle of the climbing slope provided in the upper layer is configured to be closer to plane.

It is thus possible to provide the image-forming apparatus in which discharged sheets of paper are not piled up on the sheet-receiving unit in a curled state or the discharged sheet does not push out the sheet piled on the sheet-receiving unit.

In the case where the discharged sheet of paper gets curled, the curled situation varies depending on the type of paper, the one-side printing and double face printing, overprinting, overwriting, printing density, and the like. When the discharged sheet, which is curled more or less, touches the top surface of the sheet-receiving unit, the optimal angle of the sheet-receiving unit is different from the conditions. In accordance with the present invention, the variable tray is configured to change the angle thereof, and it is possible to adjust to have the optimal angle. In order to adjust the angle of the variable tray, the stopper may be used for adjusting in stages. Additionally, the discharged sheet gets curled not only downwardly but also upwardly. If the discharged sheet gets curled upwardly, the variable tray may be positioned close to plane or flat, and it is possible to prevent the discharged sheets from piling up in a curled state. Further, in the case where the elastic material is incorporated into the variable tray, the weight of the piled sheets makes the variable tray in the down state. In the case where the variable tray is in the down state, more sheets can be stacked. The elastic material may be a conventionally known material such as a spring or the like.

The supporting point is provided apart from the sheet discharge direction start point of the sheet-receiving unit by at least half as long as a discharge direction length of a largest sheet size on which an image is intended to be formed, because the variable tray will hinder the discharged sheet, if the supporting point of the variable tray is very close to the sheet discharge direction starting point portion. That is to say, the variable tray is capable of touching the front edge of the discharge direction so as to prevent the discharged sheet from piling up in the curled state. On the other hand, if the variable tray is arranged close to the sheet discharge direction starting point portion in a sheet discharge direction, the sheet of paper may not be discharged completely or perfectly. In accordance with the present invention, in order to avoid the aforementioned drawback, the supporting point is provided apart from the sheet discharge direction start point of the sheet-receiving unit by at least half as long as a discharge direction length of a largest sheet size on which an image is intended to be formed. The discharged sheet easily gets curled, as the discharged sheet becomes larger. However, a sufficient effect can be realized in the large-sized sheet, in accordance with the present invention.

In the case where the sheet discharge direction starting point portion is incorporated into the top board of the container that includes the fixing unit, the discharged sheet can be stopped at the end of the sheet discharge direction starting point portion, and thereby the discharged sheet does not hinder the discharge of the paper. In the case where the slope portion is formed on the side of the sheet discharge direction starting point portion, a concave portion is formed on the side of the sheet discharge direction starting point portion of the container. The discharged sheet is piled up on the concave portion and gets touch in the wall forming the concave portion. It is thus possible to stack the discharged sheets on the sheet-receiving unit.

In the above-mentioned image-forming apparatus includes a color image-forming apparatus. In the case where the plane surface portion is provided on the top board of the container that includes the fixing unit, a cubic content of the container is reduced by an area of the plane surface portion, and the space inside the container is thus limited. In the container, in addition to the fixing unit, the toner cartridges are included. If the image-forming apparatus is a single color image-forming apparatus, black (K) toner cartridge is only included here. However, if the image-forming apparatus is a color image-forming apparatus, three more cartridges, Yellow, Magenta, and Cyan, are included. The toner cartridges have shapes of cylinder, and in general, the black cartridge is smaller than those of other cartridges. The toner cartridges having smaller diameters can be included in the container in accordance with the present invention. It is thus possible to prevent the discharged sheet getting curled and reduce the space or cubic content of the image-forming apparatus.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image-forming apparatus comprising:

a sheet discharge tray that includes a slope portion sloped at an angle from a reference line, a plane surface portion, and a variable tray connected to the sheet discharge tray at a supporting point provided between the slope portion and the plane surface portion, the sheet discharge tray extending from a start point to an end point;

a black toner cartridge that is disposed below the supporting point; and an image-forming unit that is not packaged within the toner cartridge, wherein the reference line extends through the start point horizontally, a center of the black toner cartridge is located above the reference line, and the image-forming unit is disposed below the reference line.

2. The image-forming apparatus as claimed in claim 1, further comprising a concave slope or a cutout portion provided at the end point of the sheet discharge tray.

3. The image-forming apparatus as claimed in claim 1, further comprising a stopper that supports the variable tray so that the variable tray maintains a given angle.

4. The image-forming apparatus as claimed in claim 1, wherein the variable tray is supported by oil pressure to vary and control an angle of the variable tray.

5. The image-forming apparatus as claimed in claim 1, further comprising an elastic member that elastically supports the variable tray, wherein an angle of the variable tray is changed by the weight of the sheets piled on the variable tray.

6. The image-forming apparatus as claimed in claim 1, wherein the entire toner cartridge is located above the reference line.

7. The image-forming apparatus as claimed in claim 1, further comprising a plurality of color toner cartridges, the black toner cartridge and the color toner cartridges arranged in a line parallel to the reference line below the plane surface portion.

8. An image forming apparatus comprising:

a sheet discharge unit that includes a slope portion that extends in a sheet discharge direction from a start point;

a variable tray rotatably attached to a distal end of the slope portion at a supporting point, a distal end of the variable tray forming an end point;

a black toner cartridge that is disposed below the supporting point; and an image-forming unit that is not packaged within the toner cartridge, wherein a center of the black toner cartridge is located above a reference line that extends horizontally through the start point, and the image-forming unit is disposed below the reference line.

9. The image forming apparatus as claimed in claim 8, further comprising a stopper that supports the distal end of the variable tray and that sets an angle of the variable tray.

10. The image forming apparatus as claimed in claim 9, further comprising an elastic member that supports the distal end of the variable tray.

11. The image forming apparatus as claimed in claim 10, wherein the elastic member comprises a torsion spring or a compression spring.

12. The image forming apparatus as claimed in claim 8, further comprising an elastic member that supports the distal end of the variable tray and that sets an angle of the variable tray.

13. The image forming apparatus as claimed in claim 12, wherein the elastic member comprises a torsion spring or a compression spring.

14. The image forming apparatus as claimed in claim 8, further comprising:

an additional sheet discharging unit comprising a sloped sheet discharge tray.

15. The image forming apparatus as claimed in claim 14, wherein an angle between the sloped sheet discharge tray and an additional reference line that extends horizontally through a start point of the sloped sheet discharge tray is less than an angle between the slope and the reference line of the sheet discharge unit.

16. The image forming apparatus as claimed in claim 14, wherein the additional sheet discharging unit is located downstream from the sheet discharging unit in the sheet discharge direction.

17. The image forming apparatus as claimed in claim 8, wherein the entire toner cartridge is located above the reference line.

18. The image forming apparatus as claimed in claim 8, further comprising a plurality of color toner cartridges, the black toner cartridge and the color toner cartridges arranged in a line parallel to the reference line below the plane surface portion.

19. An image-forming apparatus comprising:

a first sheet discharge tray that includes a first slope portion sloped at a first angle from a first reference line, a plane surface portion, and a variable tray connected to the first sheet discharge tray at a supporting point provided between the first slope portion and the plane surface portion, the first sheet discharge tray extending from a start point to an end point;

a second sheet discharge tray that includes a second slope portion sloped at a second angle less than the first angle from a second reference line;

a toner cartridge that is disposed below the supporting point; and an image-forming unit that is not packaged within the toner cartridge, wherein the first reference line extends through the start point horizontally, a center of the toner cartridge is located above the first reference line and below the second reference line, the first reference line and the second reference line are substantially parallel to one another, and the image-forming unit is disposed below the first reference line.

* * * * *